US008171866B2

(12) United States Patent
Dunstan

(10) Patent No.: US 8,171,866 B2
(45) Date of Patent: May 8, 2012

(54) SAFE CONSTRUCTION FOR SWING AND SLIDE DOOR

(75) Inventor: Brett Dunstan, Hallam (AU)

(73) Assignee: Lokaway Pty. Ltd., Hallam, Victoria (AU)

( * ) Notice: Subject to any disclaimer, the term of this patent is extended or adjusted under 35 U.S.C. 154(b) by 896 days.

(21) Appl. No.: 11/992,504

(22) PCT Filed: Sep. 22, 2006

(86) PCT No.: PCT/AU2006/001392

§ 371 (c)(1),
(2), (4) Date: Mar. 24, 2008

(87) PCT Pub. No.: WO2007/033428

PCT Pub. Date: Mar. 29, 2007

(65) Prior Publication Data

US 2009/0260552 A1 Oct. 22, 2009

(30) Foreign Application Priority Data

Sep. 22, 2005 (AU) ..... 2005905221

(51) Int. Cl.
*E06B 3/50* (2006.01)

(52) U.S. Cl. ..... 109/70; 109/74; 16/239; 49/254

(58) Field of Classification Search ..... 109/64, 109/69, 70, 74, 75; 49/254, 257, 258, 324, 49/358, 394; 16/239, 362, 364
See application file for complete search history.

(56) References Cited

U.S. PATENT DOCUMENTS

| | | | | | |
|---|---|---|---|---|---|
| 825,253 | A | | 7/1906 | Watson | |
| 915,397 | A | | 3/1909 | Weiss | |
| 958,624 | A | | 5/1910 | Glazier | |
| 990,469 | A | | 4/1911 | Anderson | |
| 1,749,222 | A | * | 3/1930 | Merriam | 109/74 |
| 1,873,522 | A | | 8/1932 | Abbott et al. | |
| 2,201,948 | A | * | 5/1940 | Watkins | 109/69 |
| 2,936,206 | A | | 5/1960 | Wilmer et al. | |
| 3,270,462 | A | | 9/1966 | Obadal et al. | |
| 3,481,288 | A | | 12/1969 | Teleky | |
| 3,715,998 | A | * | 2/1973 | Teleky | 109/58 |
| 3,788,689 | A | | 1/1974 | Lloyd | |
| 4,070,074 | A | | 1/1978 | Rohme | |
| 4,262,447 | A | | 4/1981 | Schneier | |

(Continued)

FOREIGN PATENT DOCUMENTS

AU A-17475/88 8/1988

(Continued)

*Primary Examiner* — Suzanne Barrett
*Assistant Examiner* — Christopher Boswell
(74) *Attorney, Agent, or Firm* — D. Peter Hochberg; Sean F. Mellino; Daniel J. Smola

(57) ABSTRACT

A safe of the swing and slide type has a closing stile which has a landing surface for the safe door and a pocket for housing the closing edge of the door. That edge is outwardly turned to prevent the insertion of a pry bar between the door and the hook of the closing stile. The pocket has a ramp face which guides the closing edge of the door during the slide open and slide closed phases. In different variants, a ramp face is provided on the door also; a second ramp face is provided on the hook of the closing stile; a door seat is incorporated into ramp.

14 Claims, 5 Drawing Sheets

U.S. PATENT DOCUMENTS

| | | | | | |
|---|---|---|---|---|---|
| 4,294,040 | A | | 10/1981 | Crotti | |
| 4,367,684 | A | | 1/1983 | Jucker | |
| 4,372,603 | A | * | 2/1983 | Stanczak et al. | 49/246 |
| 4,548,330 | A | | 10/1985 | Hewitt et al. | |
| 4,679,353 | A | | 7/1987 | Langenbach et al. | |
| 4,704,970 | A | | 11/1987 | Sanderson et al. | |
| 4,712,490 | A | | 12/1987 | Lichter | |
| 4,852,503 | A | | 8/1989 | Lichter | |
| 4,932,160 | A | | 6/1990 | Sperko | |
| 5,056,262 | A | | 10/1991 | Schweiss et al. | |
| 5,931,104 | A | | 8/1999 | Horn et al. | |
| 5,953,860 | A | | 9/1999 | Morgan et al. | |
| 5,971,515 | A | | 10/1999 | Baker et al. | |
| 6,161,336 | A | | 12/2000 | Ziv-Av | |
| 6,843,184 | B2 | * | 1/2005 | Wall et al. | 109/74 |
| 7,404,363 | B2 | * | 7/2008 | Dunstan | 109/70 |
| 7,793,600 | B2 | * | 9/2010 | Dunstan | 109/70 |
| 2006/0037519 | A1 | * | 2/2006 | Dunstan | 109/74 |

FOREIGN PATENT DOCUMENTS

| | | | |
|---|---|---|---|
| AU | A-11342/95 | | 3/1995 |
| AU | 2000 12438 | A1 | 7/2000 |
| CA | 2325318 | | 5/2002 |
| DE | 201 09 557 | U1 | 10/2001 |
| EP | 0145079 | | 6/1985 |
| EP | FR 2728010 | | 6/1996 |
| EP | 0607040 | | 9/1997 |
| EP | 0637674 | | 4/1998 |
| FR | 928 207 | | 11/1947 |
| FR | 79 12649 | | 12/1980 |
| WO | WO 96/29496 | | 9/1996 |
| WO | WO 99/50519 | | 10/1999 |
| WO | WO 00/79084 | A1 | 12/2000 |
| WO | WO 01/61132 | | 8/2001 |
| WO | WO 01/71140 | A1 | 9/2001 |
| WO | WO 02/059528 | A1 | 8/2002 |
| WO | WO 02/101185 | A1 | 12/2002 |
| WO | WO 2004/033835 | | 4/2004 |

* cited by examiner

SAFE CONSTRUCTION FOR SWING AND SLIDE DOOR

CROSS-REFERENCE TO RELATED APPLICATION

This application is a National Stage application of International Application No. PCT/AU2006/001392, filed on Sep. 22, 2006, which claims priority from Australian Application Serial No. 2005905221 filed on Sep. 22, 2005.

BACKGROUND OF THE INVENTION

1. Field of the Invention

This invention concerns security door and frame construction and relates primarily to safes but is applicable to security doors.

2. Description of the Prior Art

In our co-pending Australian application for Patent No. 2003252867, we describe security door constructions of the swing and slide type. The door frame has an upright for supporting the door on an offset hinge and the upright of the frame opposite the hinge has a slot capable of receiving the closing edge of the door, which upon closing slides into the slot and upon opening, slides out of the slot.

The slide motion of the door precedes the opening swing and it is this retraction of the door from the slot which intruders try to achieve. The door is free to slide on the hinges and must be retained in the locked position by door bolts. We describe hook and slot formations in the above application which resist prying forces applied to the door. In co-pending Australian application no. 2004231234, we describe a horizontal bar which slides across the width of the door when the safe is locked and abuts the safe wall adjacent the door hinge. Prying forces tending to slide the door open are transmitted to the safe wall and resisted.

In co-pending Australian application no. 2005901184, we describe door mounted rise and fall hooks which drop into vertical slots in the closing stile of the door frame when the door is locked. These are both effective measures for resisting forces exerted by prying bars applied to the door frame, that is between the door and the closing stile.

In safes such as gun safes which are made from plate 2-3 mm thick, the above devices exert locking force at various sites and the metal between these sites could be bent. It would be desirable to resist prying by increasing the difficulty of inserting the prying bar into the gap between the door and the closing stile so that effective leverage cannot be applied.

SUMMARY OF THE INVENTION

The apparatus aspect of the invention provides a safe of the swing and slide type having a closing stile which provides a landing surface for the safe door and a pocket for housing the closing edge of the door, wherein the door has a outwardly turned closing edge for the purpose of denying access to the door edge by a pry tool inserted between the door and the closing stile.

The closing stile may have a portion against which the outward face of the door is intended to abut in the closed position and the pocket has a ramp surface adjacent the landing surface which the closing edge contacts as the door slides to the closed position in which locking follows and passage of the closing edge over the ramp surface forces the front face of the door against the portion of the closing stile.

The inclined portion of the slot may have a front inclined wall and a rear inclined wall. The rear inclined wall acts as a ramp surface contacted by the rear surface of the door edge as the door closes causing the door edge to abut the door stile tightly.

The front inclined wall acts as a ramp surface for the flange, directing the door away from the door stile toward the landing surface when the door is slid open.

The front inclined wall may be formed by bending the free edge of the closing stile.

The landing surface may be provided by a wall parallel to the door but projecting from the safe wall adjacent the closing stile.

The rear inclined wall may extend from the projecting wall to the closing stile.

It is convenient if the rear inclined wall is part of a component of modified channel section which permits reinforcement of the hollow door stile. Reinforcement is made possible by giving the component a profile which partly matches the door stile profile and during manufacture putting the component inside the channel part of the door stile so that the component and channel fit face to face and increase the stiffness of the closing stile.

The flange may be formed by bending the door edge and may be 5-15 mm deep, preferably 10 mm deep. In this specification the term "flange" is intended to include a lip made by bending a single plate at 70-90°; a projection at 90° made by fabricating bent sections; a lip with an integral incline which is intended to assist the exit of the door from the door pocket. The flange may be of constant or tapering thickness.

BRIEF DESCRIPTION OF THE DRAWINGS

One embodiment of the invention is now described with reference to the accompanying drawings, in which.

DETAILED DESCRIPTION OF THE PREFERRED EMBODIMENTS

Figure 1:
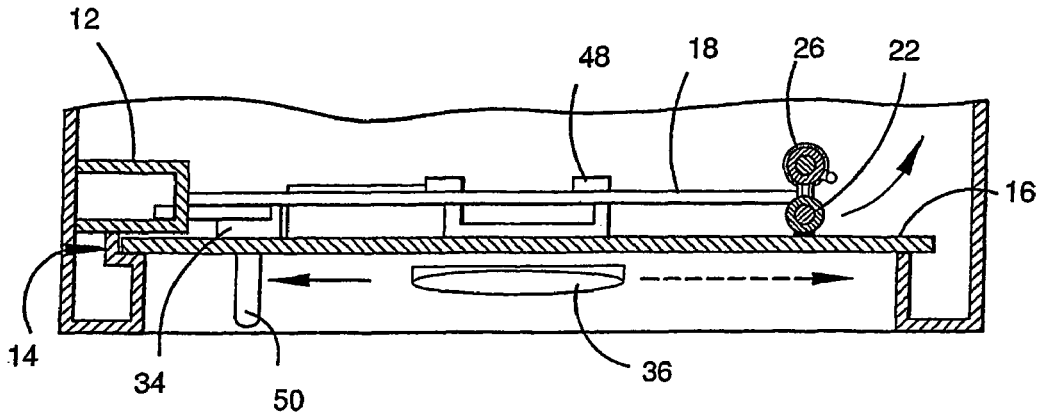
FIG. 1 is a sectional plan through the door and frame of our co-pending application no. 2003252867 in the closed and locked position.
Figure 2:
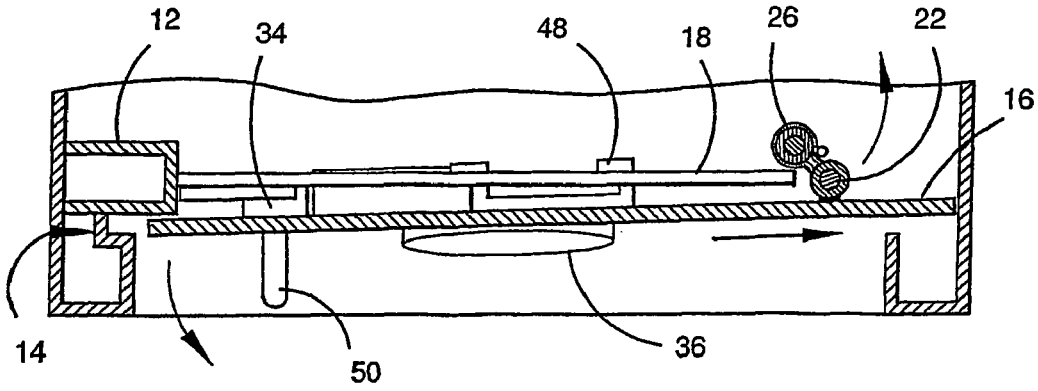
FIG. 2 is the same view but showing the door ready to swing open.

Referring now to FIGS. 1 and 2 of the drawings in which the numerals are in sequence taken from FIG. 1 which represents published art. The door 16 is wider than the gap between the door stiles 4, 6. The door is mounted on pairs of hinges 22, 26 and the slide motion LEFT and RIGHT is controlled easily by knob 52, a crank and reaction bar (not shown) as described in Australian application no. 2003966471.

Figure 3:
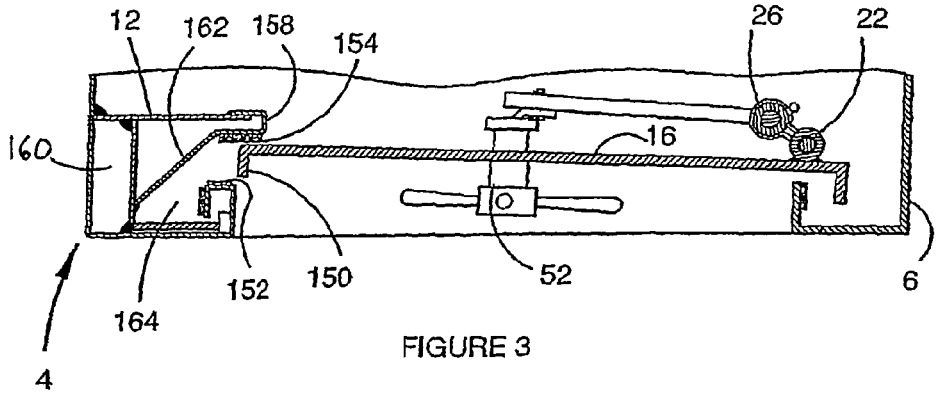
FIG. 3 is a sectional plan of the door and frame of this invention ready to open with the locking devices omitted for clarity.
Figure 4:
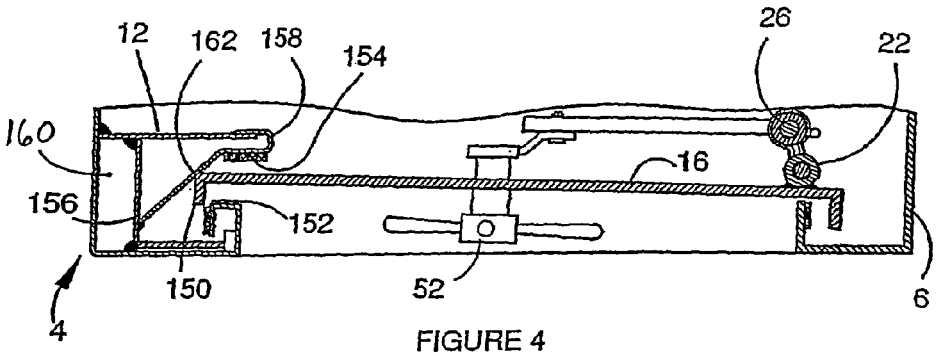
FIG. 4 is a sectional plan of the door and frame half way through the open/close position showing the deflection path of the door edge.
Figure 5:
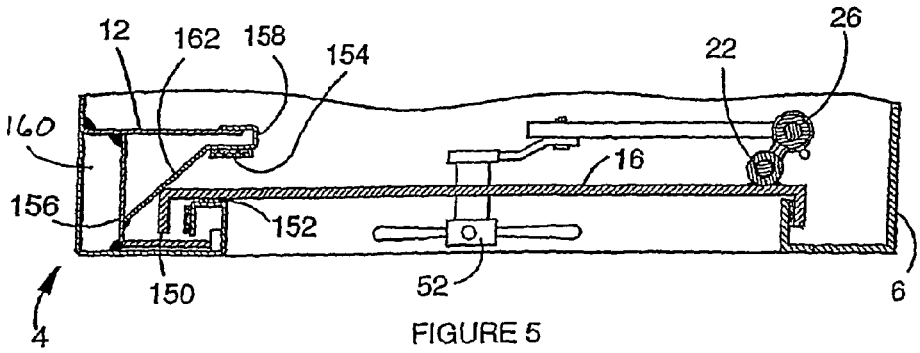
FIG. 5 is a sectional plan of the door and frame of FIG. 2 shown in a closed and locked position.

Referring now to FIGS. 3, 4 and 5, door stile 6 remains the same as in the known safe but closing stile is modified and the door closing edge is modified. The door edge is bent away from the safe interior to form a 10 mm deep flange 150. The slot 14 is widened to accommodate the flange.

The closing stile 4 includes a box section steel closer 12, an angle section 156 and a R-shaped section 158. Closing stile 4 terminates in a hook section 152, the top of which lies parallel to a landing surface 154. Hook section 152 and landing surface 154 are separated by about 15 mm in this embodiment. The corner of the stile 4 is strengthened by angle section 156 and R-shaped section 158. Closer 12 and angle section 156 form a box section 160. R-shaped section 158 forms landing surface 154 and a ramp 162. The slot shown in FIGS. 1 and 2 widens to form a pocket 164 extending the full height of the door.

In FIG. 3 the rear face of the door 16 when swung on hinge 26 strikes the landing surface 154. When handle 52 rotates, the door swings about hinge 26 and slides toward the close/lock position where the edge of the door is deflected by ramp 162 and is forced against hook section 152 (see FIG. 5).

Figure 6:
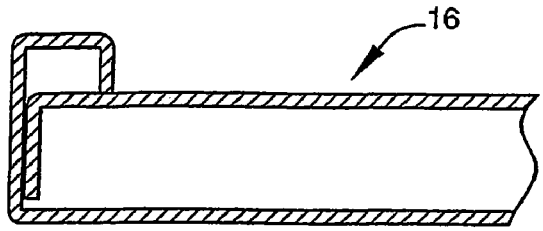
FIG. 6 is a sectional fragment of the 90° door edge when made of bent plate components.

Referring now to FIG. 6, the door may be hollow and fabricated from plate so that the flange 150 is made from a hook section and an angle section.

Figure 7:
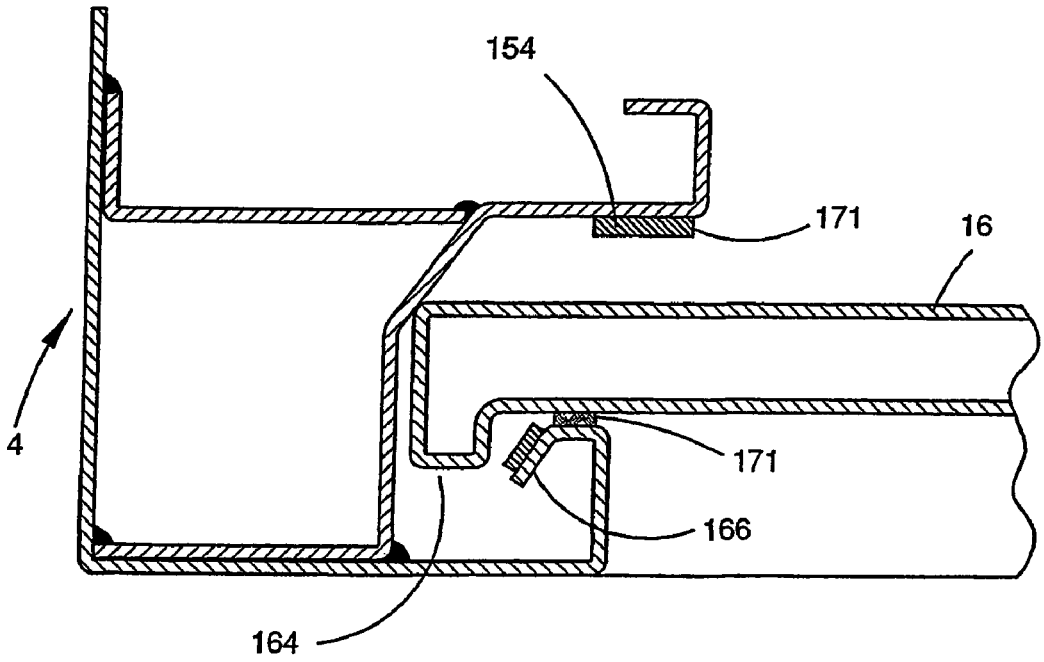
FIG. 7 is a sectional fragment of the door edge of a thick plate door.

FIG. 7 shows how the flange of FIG. 6 is modified to provide a second or exit ramp 166. When the handle 52 turns to open the door, the flange rides over exit ramp 166 and slides over the landing surface 154.

Figure 8:
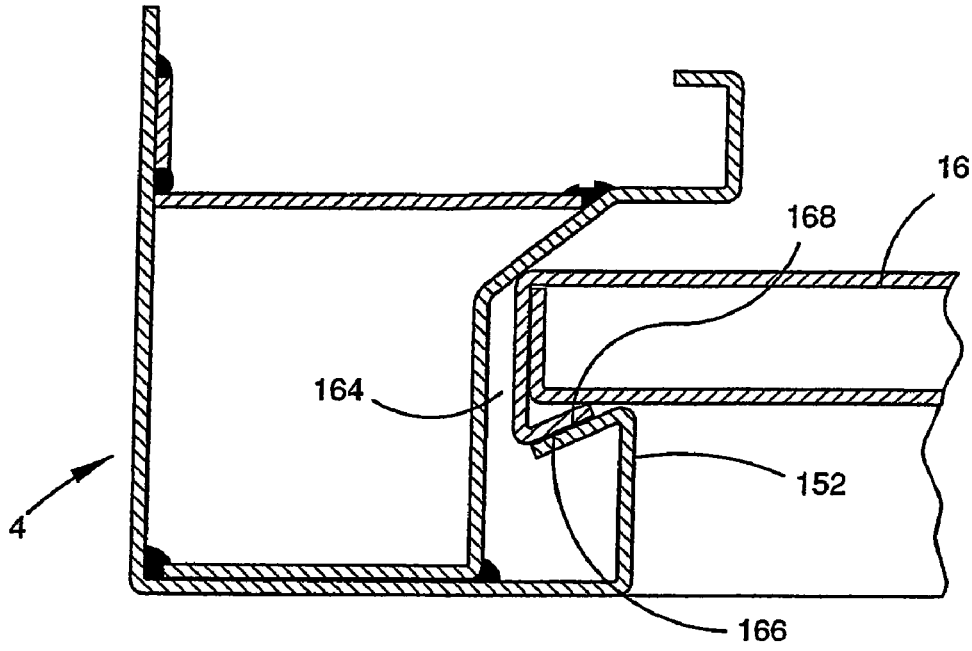
FIG. 8 is a sectional fragment of the door edge when made as a hollow plate fabrication.

In FIG. 8 hook section 152 is modified to include the exit ramp 166. In addition, the door is fabricated from plate sections which include an incline 168. Upon commencing to slide open, incline 168 rides up exit ramp 166.

Figure 9:
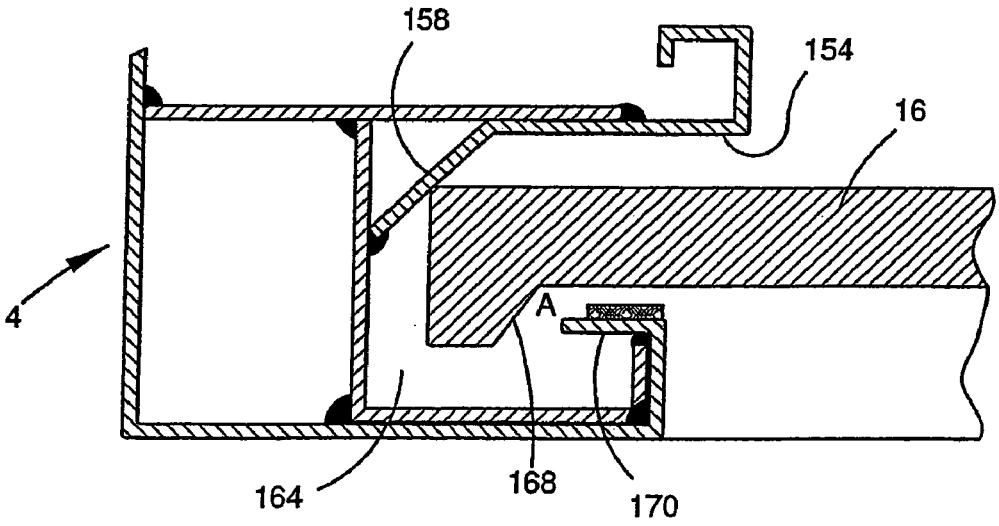
FIG. 9 is a sectional fragment of a thick plate door edge with an incline which contacts the free edge of the closing stile.

In FIG. 9 the hook section 152 is simplified and presents a free edge 170 to the door edge. The flange 150 of the door is modified in that the incline 168 is provided in the door instead of being part of the portion of the closing stile. The incline subtends an obtuse angle "A" with the front face of the door.

The strips of foam 171 in FIG. 9 and the earlier Figures are fire seals which react to fire by swelling in volume and closing the gap between the metal surfaces of the safe.

Figure 10:
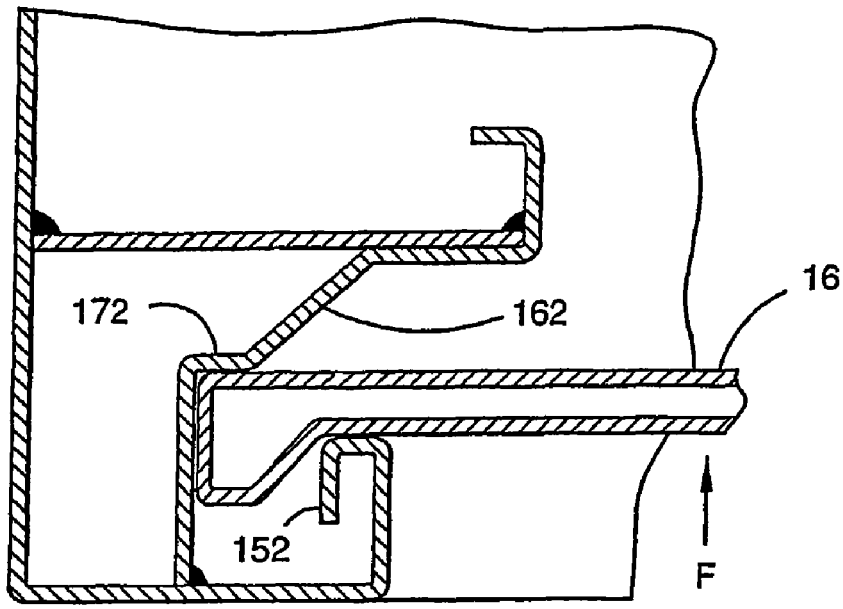
FIG. 10 is a sectional fragment of a refinement of the embodiment in FIG. 9, having a seat for the closed door which resists frontal force on the door.

In FIG. 10 the ramp surface 162 is modified in that it leads to a seat 172 about 10 mm wide against which the corner of the external corner of the door 16 rests when closed and locked. The front face of the door abuts the hook formation 152 on the closing stile. Both faces of the door make contact with the closing stile when the door is closed.

Figure 11:
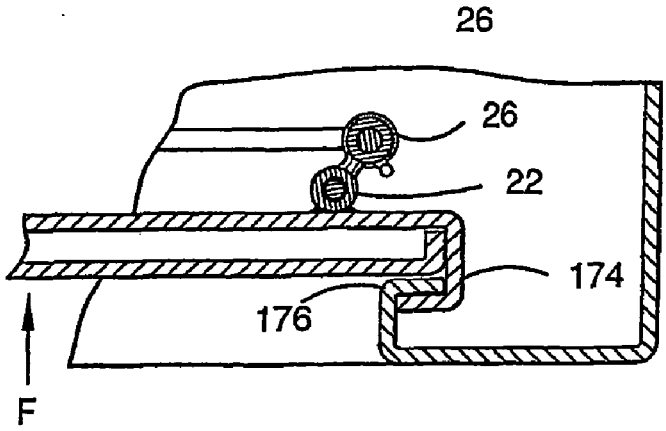
FIG. 11 is a sectional fragment of the opposite edge of the door.

In FIG. 11 the door is made from bent sections similar to those shown in FIG. 6. The hinge end of the door is modified to create a hook formation 174 which cooperates with a complementary hook formation 176 on the opening stile. When the door slides to the RIGHT on hinge 26 and then swings around hinge 22, the hook formations separate and allow the door to open about 90°.

The modifications in FIGS. 10 and 11 are intended to resist a frontal force F on the door such as by ramming the centre of the door or the application of an impact tool.

We have found the advantages of the above embodiment to be:

1. An intruder has less access with a prying bar because closing causes the door to abut the closing stile.

2. The hinges and locking parts need not be as robust to achieve the same resistance to prying.

3. The improvement does not interfere with the installation or operation of conventional components such as pins which shoot in and out of the frame or door hooks which engage slots in adjacent frame components.

It is to be understood that the word "comprising" as used throughout the specification is to be interpreted in its inclusive form, i.e. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A safe of the swing and slide type, said safe having an interior space, opposite sides and a front, said safe comprising:

a safe door extending across the front of the safe and including an outward face, an inward face facing the interior space, a closing edge and an opening edge, said closing edge being turned outwardly towards the exterior of the safe, and said safe door being movable between an open position and a closed position for protecting the interior space;

an offset hinge assembly located in the interior space protected by said safe door behind the inward face and away from the outward face of said safe door, said offset hinge assembly permitting a sideways slide motion of said safe door between the opposite sides of the safe, and a swing motion of said safe door for allowing said safe door to move between the open position and the closed position;

a closing stile for providing a landing surface for said safe door; and a door pocket for housing the closing edge of said safe door, said outwardly turned closing edge denying access to the closing edge by a pry tool inserted between said safe door and the closing stile, wherein the slide motion of said safe door precedes the opening swing motion of said safe door by a lateral retraction of said safe door from said door pocket when said safe door is opened, wherein the slide motion of said safe door follows the closing swing motion of said safe door by insertion of said safe door into said door pocket when said safe door is closed.

2. A safe as claimed in claim 1, wherein the closing stile further comprises:

an abutting portion for abutting the outward face of said safe door in the closed position; and wherein said door pocket has a ramp surface adjacent said landing surface, said landing surface contacting said closing edge as said safe door slides to the closed position, and wherein passage of said closing edge over said ramp surface forces the front face of said safe door against the abutting portion of the closing stile to lock said safe door in the closed position.

3. A safe as claimed in claim 2, wherein the ramp surface is an inclined wall.

4. A safe as claimed in claim 2, wherein the abutting portion is a hook section.

5. A safe as claimed in claim 2, further comprising a fire foam seal located on the abutting portion and lying between the door and the abutting portion.

6. A safe as claimed in claim 2, wherein the closing stile further comprises a seat operatively connected to said ramp surface for bracing the closing edge of the door from a frontal force exerted on the door.

7. A safe as claimed in claim 2, wherein said abutting portion further includes an exit ramp spaced from the ramp surface for guiding the door on movement towards the opening position.

8. A safe as claimed in claim 7, wherein the outwardly turned closing edge lies substantially at 90° to the door.

9. A safe as claimed in claim 7, wherein the outwardly turned closing edge has an internal corner and an external corner and the external corner subtends about 90° and the internal corner subtends an obtuse angle.

10. A safe as claimed in claim 2, wherein the portion of the closing stile has a free edge and the outwardly turned closing edge of the door has an incline for contacting the free edge when the door commences to slide towards the open position.

11. A safe as claimed in claim 2, wherein the opening edge of the door is outwardly turned.

12. A safe as claimed in claim 11, further comprising an opening stile having a hook formation; and wherein the outwardly turned opening edge of the door has a complementary hook formation, said opening stile and opening edge cooperating to resist a frontal exerted on the door when closed.

13. A safe as claimed in claim 1, wherein the closing edge is a flange.

14. A safe as claimed in claim 13, wherein the door pocket has an inclined surface for engaging the door as the door moves towards the closed position, and the abutting portion of the closing stile is spaced from the inclined wall to enable the door to pass between the abutting portion and the inclined wall as the door is moved to the closed position.

* * * * *